US012781578B1

(12) United States Patent
Nagarajan et al.

(10) Patent No.: US 12,781,578 B1
(45) Date of Patent: Nov. 3, 2026

(54) AUTOMATIC DRILL BIT CHANGING MAGAZINE

(71) Applicant: Caterpillar Global Mining Equipment LLC, Denison, TX (US)

(72) Inventors: Ravi Kumar Nagarajan, Chennai (IN); Scott Alan Christianson, Edelstein, IL (US)

(73) Assignee: Caterpillar Global Mining Equipment LLC, Denison, TX (US)

( * ) Notice: Subject to any disclaimer, the term of this patent is extended or adjusted under 35 U.S.C. 154(b) by 0 days.

(21) Appl. No.: 19/243,125

(22) Filed: Jun. 19, 2025

(51) Int. Cl.
*E21B 19/15* (2006.01)
*E21B 19/20* (2006.01)

(52) U.S. Cl.
CPC ..... *E21B 19/155* (2013.01); *E21B 19/20* (2013.01)

(58) Field of Classification Search
CPC ..... E21B 19/155; E21B 19/20
See application file for complete search history.

(56) References Cited

U.S. PATENT DOCUMENTS 2,972,388 A 2/1961 Thornburg
4,897,009 A 1/1990 Powell
9,644,436 B2 5/2017 Hoult
9,945,193 B1 4/2018 Orgeron
11,136,839 B2 10/2021 St Pierre
11,898,406 B2 2/2024 Fosler
2023/0038886 A1* 2/2023 Bender ..... E21B 19/18
2024/0218752 A1* 7/2024 Fosler ..... E21B 19/20

FOREIGN PATENT DOCUMENTS

CN 216588455 U 5/2022
CN 118881320 A 11/2024
EP 2310616 B1 10/2017

* cited by examiner

*Primary Examiner* — Nicole Coy
*Assistant Examiner* — Nicholas D Wlodarski

(57) ABSTRACT

A magazine for auto drill-bit changes. The magazine includes a housing including at least one sidewall and at least two drill-bit pockets. The magazine also includes a bracket, the housing pivotably coupled to the first end of the bracket, and a lid a lid dimensioned to enclose the housing, the lid pivotably coupled to the housing. Additionally, a first actuator is pivotably coupled to both the housing and the bracket, and a second actuator is pivotably coupled to the housing and to the lid. The housing is actuatable between a parked position and a tilted position when the first actuator is activated, and the lid transitions between a closed position and an open position when the second actuator is activated.

13 Claims, 9 Drawing Sheets

AUTOMATIC DRILL BIT CHANGING MAGAZINE

TECHNICAL FIELD

The embodiments described herein are generally directed to drilling machinery, and, more particularly, to an automatic drill bit changing magazine.

BACKGROUND

During a drilling operation (e.g., drilling surface rock) by a drilling rig, the drill bit needs to be changed from time to time. To change the drill bit, the used drill bit must be removed from the drill string, the used drill bit must be stored, and a new drill bit must be installed on the drill string. Ideally, for the sake of efficiency and safety, this process would be done without direct human intervention.

SUMMARY

Disclosed herein is a magazine for auto drill-bit changes. The magazine includes a housing including at least one sidewall and at least two drill-bit pockets and a bracket having a first end and a second end. The housing is pivotably coupled to the first end of the bracket. The magazine also includes a first actuator pivotably coupled to both the housing and the bracket. The first actuator is actuatable between a first state and a second state. The magazine also includes a lid dimensioned to enclose the housing, and the lid is pivotably coupled to the housing. The magazine also includes a second actuator pivotably coupled to the housing and to the lid, the second actuator actuatable between a first state and a second state. The housing is actuatable between a parked position and a tilted position when the first actuator transitions from the first state to the second state. Additionally, the lid transitions between a closed position and an open position when the second actuator transitions from the first state to the second state.

Also disclosed herein is a drilling rig. The drilling rig includes a machine body including a platform that defines a reference axis and a mast attached to the machine body. The machine body is configured to tilt a drill between a range of angles with respect to the reference axis, wherein the range of angles includes a first angle and a second angle. Additionally, the drilling rig includes one or more ground-engaging members configured to facilitate the drill engaging a ground. The drilling rig further includes a magazine for auto drill-bit changes, wherein the magazine is attached to the platform and each of the one or more ground engaging members are disposed in one of the drill-bit pockets.

Also disclosed herein is a method of auto-changing a drill bit. The method includes determining, via a controller, to change a used drill bit and operating a magazine for auto drill-bit changes to facilitate auto-changing a drill bit. Operating the magazine includes activating the first actuator to transition the housing from the parked position to the tilted position and activating the second actuator to transition the lid from the closed position to the open position. Additionally, in response to determining to change the used drill bit, the method includes selecting an empty one of the plurality of drill-bit pockets of the magazine. The method also includes controlling the mast to tilt the drill to an angle, with respect to the reference axis, that matches an angle of the selected empty drill-bit pocket. Further, the method includes operating a drill string of the drill to release the used drill bit into the selected empty drill bit pocket. The method then includes selecting an occupied one of the plurality of drill-bit pockets in the magazine, controlling the mast to tilt the drill to an angle, with respect to the reference axis, that matches an angle of the selected occupied drill-bit pocket. Then, the method includes operating the drill string of the drill to engage a new drill bit held by the selected occupied drill-bit pocket.

BRIEF DESCRIPTION OF DRAWINGS

The details of embodiments of the present disclosure, both as to their structure and operation, may be gleaned in part by study of the accompanying drawings, in which like reference numerals refer to like parts, and in which.

DETAILED DESCRIPTION

Figure 1:
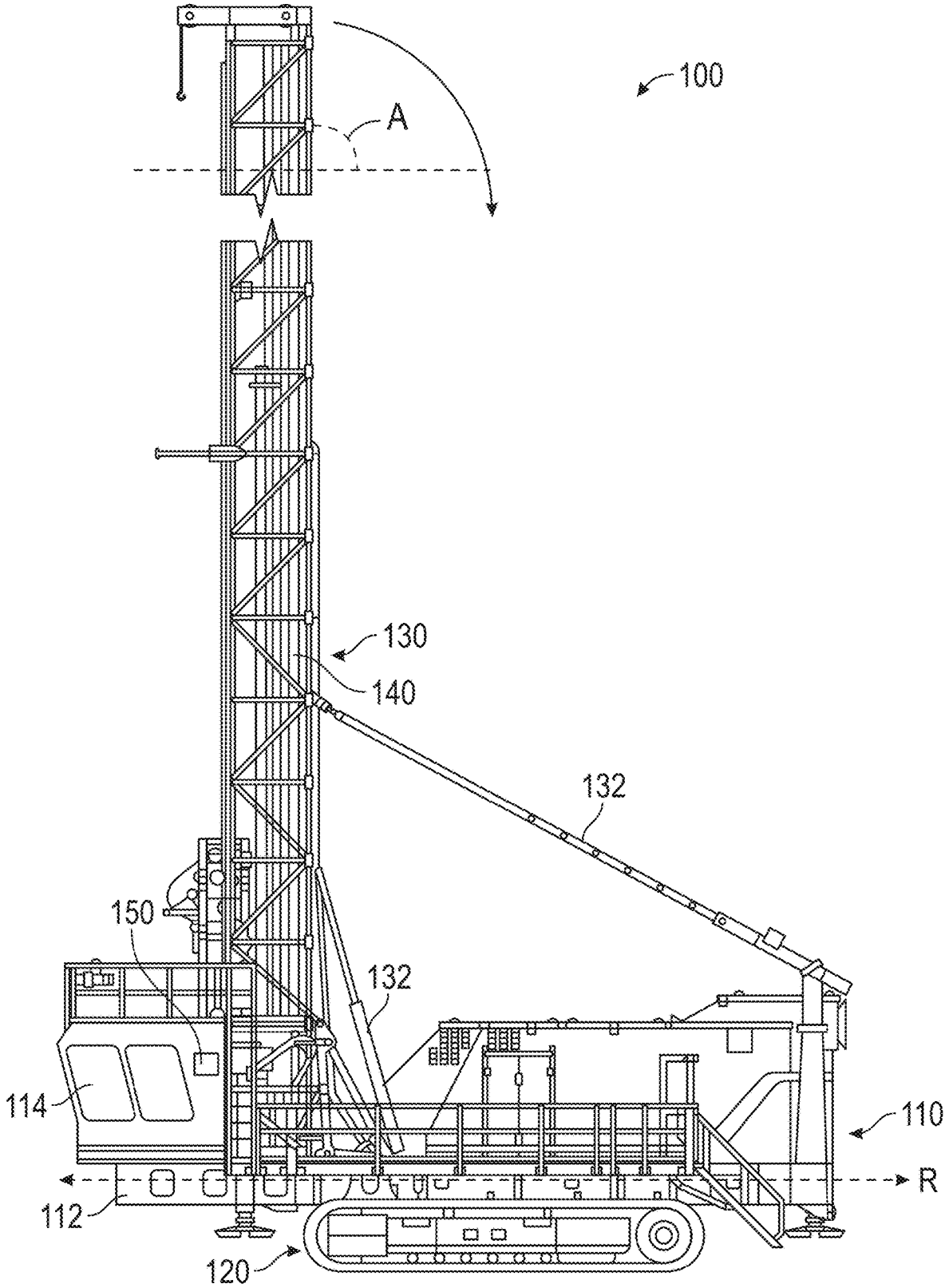
FIG. 1 illustrates a side view of a drilling rig, according to an embodiment.

The detailed description set forth below, in connection with the accompanying drawings, is intended as a description of various embodiments, and is not intended to represent the only embodiments in which the disclosure may be practiced. The detailed description includes specific details for the purpose of providing a thorough understanding of the embodiments. However, it will be apparent to those skilled in the art that embodiments of the invention can be practiced without these specific details.

In some instances, well-known structures and components are shown in simplified form for brevity of description. For clarity and ease of explanation, some surfaces and details may be omitted in the present description and figures. It should also be understood that the various components illustrated herein are not necessarily drawn to scale. In other words, the features disclosed in various embodiments may be implemented using different relative dimensions within and between components than those illustrated in the drawings.

The terms "side," "top," "bottom," "front," "rear," "above," "below," and the like are used for convenience of understanding, to convey the relative positions of various components with respect to each other, and do not imply any specific orientation of those components in absolute terms (e.g., with respect to the external environment or the ground). In addition, the terms "respective" and "respectively" signify an association between members of a group of first components and members of a group of second components. For example, the phrase "each component A connected to a respective component B" would signify A1 connected to B1, A2 connected to B2, . . . and AN connected to BN. Furthermore, a reference numeral with an appended letter will be used herein to refer to a specific component, whereas the same reference numeral without any appended letter will be used to refer collectively to a plurality of the component or to refer to a generic or arbitrary instance of the component. Similarly, a reference letter with an appended number will be used herein to refer to a specific parameter, whereas the same reference letter without any appended number will be used to refer collectively to a plurality of the parameter or to refer to a generic or arbitrary instance of the parameter.

Drilling Rig

FIG. 1 illustrates a side view of a drilling rig 100, according to an embodiment. Drilling rig 100 comprises a machine body 110, which includes a platform 112 that is supported off the ground by one or more ground-engaging members 120. Platform 112, which may also be referred to as a "drill deck," defines a reference axis R. Examples of drilling rig 100 include any of the rotary drills (e.g., models numbers MD6200, MD6240, MD6250, MD6290, MD6310, MD6380, MD6420C, MD6540, MD6540C, MD6640, etc.) manufactured by Caterpillar Inc. of Irving, Texas or other manufacturers. However, it should be understood that disclosed embodiments may be applied to any drilling rig with a drill capable of being rotated through a plurality of angles.

Platform 112 may support a cabin 114, a mast 130, an internal combustion engine or electric motor (not shown), and other various components of machine body 110. Cabin 114 may be configured to accommodate a local human operator and may comprise one or more machine controls, by which the local human operator may control one or more subsystems of drilling rig 100. In an alternative embodiment, such as in the case of an autonomous or remotely controlled drilling rig 100, cabin 114 may be omitted.

Ground-engaging member(s) 120, which may be driven by an internal combustion engine or electric motor in machine body 110, are configured to move machine body 110 with respect to the ground. Ground-engaging member(s) 120 are illustrated as a pair of tracks on either side of machine body 110. However, in an alternative embodiment, ground-engaging members 120 may comprise a plurality of (e.g., four or more) wheels or the like.

Mast 130 supports a drill 140. Drill 140 may comprise components that are configured to move, relative to mast 130, so as to extend towards and into the ground below machine body 110. For example, drill 140 may comprise a drill string (not shown) with a drill bit attached to a drilling end. The drill string may extend outwards from a cylinder to drill into the ground using the drill bit.

Mast 130 is attached to machine body 110 and configured to rotate or tilt drill 140 between a range of angles with respect to reference axis R. In an embodiment, the orientation of drill 140 is fixed relative to mast 130, and mast 130 is itself configured to rotate or tilt between the range of angles with respect to reference axis R, to thereby tilt drill 140 via the fixation between mast 130 and drill 140. For example, mast 130 may be configured to tilt backwards (e.g., towards the rear of machine body 110) via one or more hydraulic supports 132. In particular, hydraulic supports 132 may be configured to retract (e.g., by reducing hydraulic pressure within the respective hydraulic cylinder) to tilt mast 130 down, and extend (e.g., by increasing hydraulic pressure within the respective hydraulic cylinder) to tilt mast 130 up. In an alternative embodiment, other means may be used to tilt mast 130 through the range of angles.

In the illustrated example, the angle A of mast 130, relative to reference axis R, is 90 degrees (°), which may be an upper limit of the range of angles of mast 130. Mast 130 may be configured to tilt down to a 0° angle, such that mast 130 is lying horizontally on platform 110. In this case, the range of angles is from 0° to 90°. Mast 130 may be fixable at each of a plurality of angles within the range of angles (e.g., via a locking mechanism), to thereby fix both mast 130 and drill 140 at that angle. Once fixed at a particular angle with respect to reference axis R, drill 140 may be operated to drill into the ground at that angle.

Drilling rig 100 may comprise a controller 150 that is configured to perform one or more of the processes described herein, including automatically changing drill bits (as will be discussed in greater detail in connection with FIGS. 9-11). While controller 150 is illustrated in a particular location on machine body 110, it should be understood that controller 150 may positioned in any alternative location on drilling rig 100, as may be dictated by one or more design factors. In addition, while controller 150 is illustrated as a single unit, controller 150 may, in practice, comprise a plurality of separate, but communicatively coupled, control units, distributed at various positions throughout drilling rig 100.

Controller 150 may be an electronic control unit (ECU) that controls one or more subsystems of drilling rig 100 (e.g., the engine or motor driving ground-engaging members 120, hydraulic supports 132 of mast 130, the drill string of drill 140, etc.). Control may be provided by a local human operator (e.g., via machine control(s) in cabin 114), a remote human operator (e.g., via a remote terminal that is communicatively coupled to controller 150 via a wireless communication interface), and/or by an autonomous system (e.g., implemented by controller 150 or other control system onboard drilling rig 100, or remote from drilling rig 100 and communicatively coupled to controller 150 via a wireless communication interface). Of particular relevance to disclosed embodiments, the control may comprise controlling mast 130 (e.g., via hydraulic supports 132) to tilt drill 140 to a particular angle A with respect to reference axis R.

Figure 2:
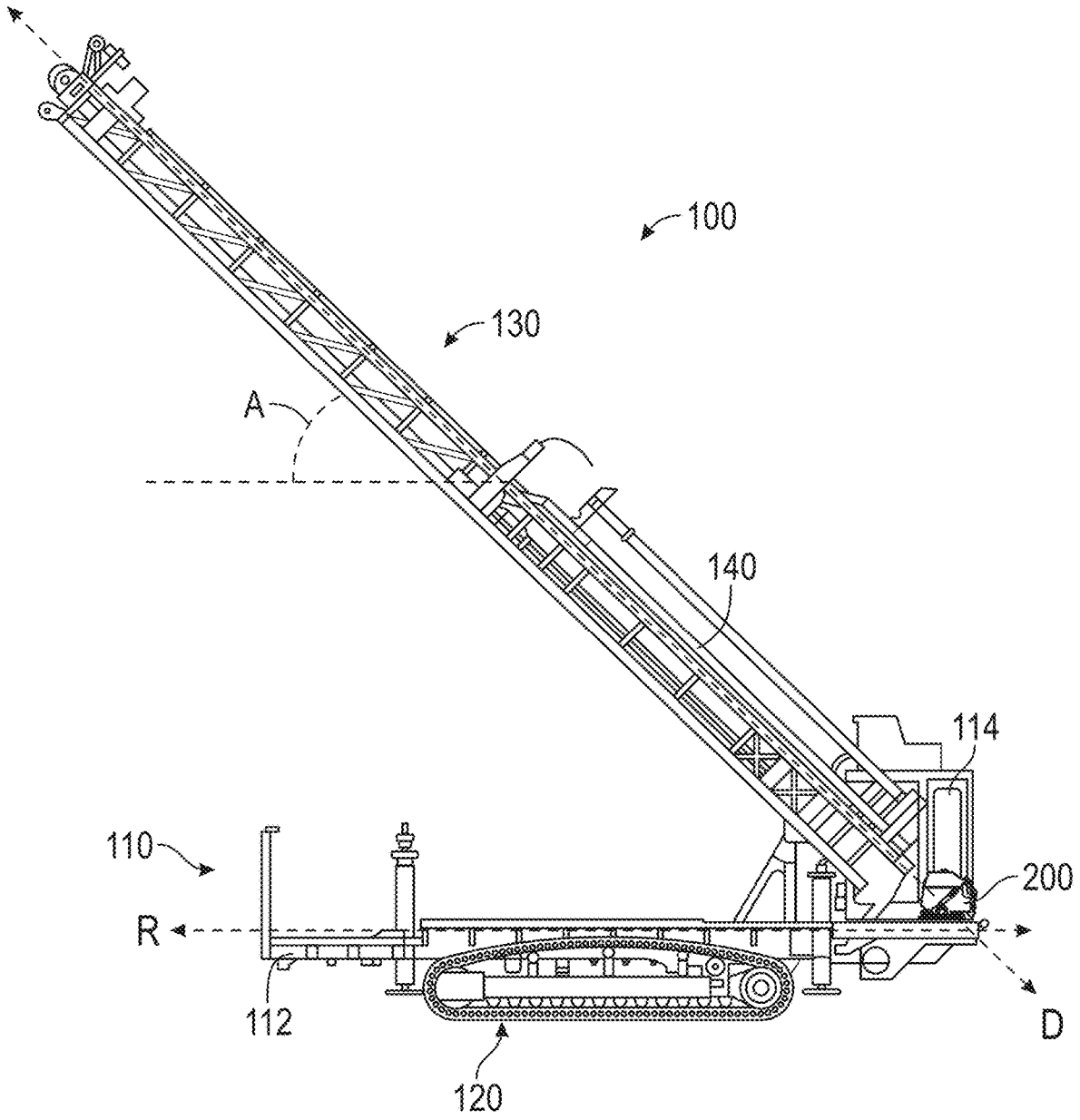
FIG. 2 illustrates a side view of a partial assembly of a drilling rig, according to an embodiment.

FIG. 2 illustrates a side view of a partial assembly of drilling rig 100, according to an embodiment. In this view, which is from the other side of drilling rig 100 as in FIG. 1, portions of machine body 110 have been removed, to more clearly illustrate components that are relevant to disclosed embodiments. As illustrated, mast 130, including drill 140 fixed therein, can be tilted to an angle A, between 0° and 90° (e.g., approximately 45° in the illustrated example).

A magazine 200 (described in greater detail in connection with FIGS. 5-8) may be attached to platform 112 of machine body 110. Magazine 200 may be positioned on platform 112, such that, when drill 140 is tilted within a sub-range of possible angles, a drill axis D of drill 140 intersects magazine 200. In an embodiment in which drill 140 tilts towards the rear of machine body 110, magazine 200 may be attached to a front end of platform 112, whereas, in an alternative embodiment in which drill 140 tilts towards the front of machine body 110, magazine 200 may be attached to a rear end of platform 112. Magazine 200 may be positioned near cabin 114, such that magazine 200 is easily accessible to a local operator of drilling rig 100. For example, magazine 200 may be positioned on a lateral side of cabin 114. As used herein, the term "lateral" should be understood to mean a horizontal orientation that is orthogonal to reference axis R.

Figure 3:
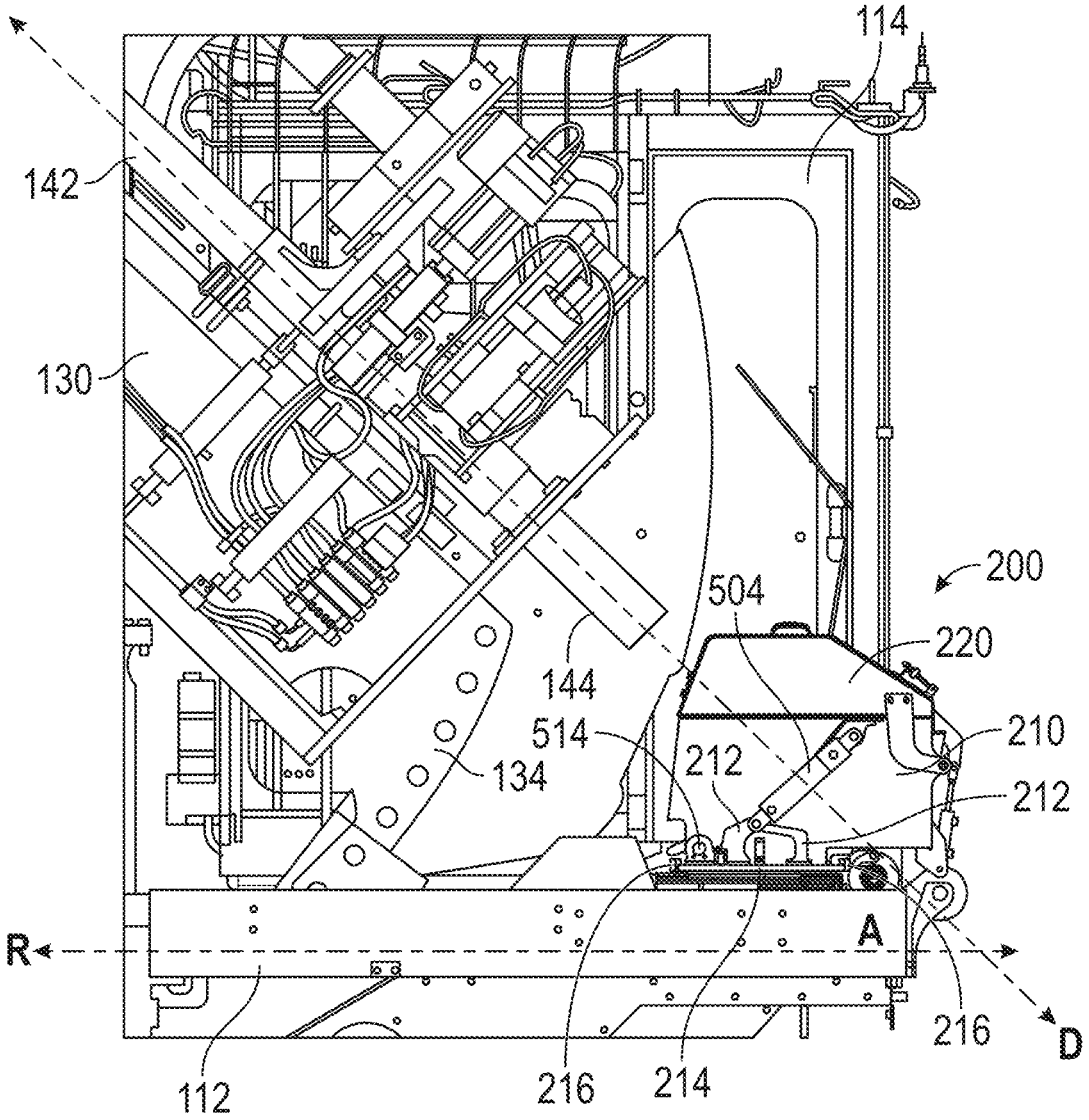
FIG. 3 illustrates a close-up side view of a partial assembly of a drilling rig, according to an embodiment.

FIG. 3 illustrates a close-up side view of a partial assembly of a drilling rig 100, according to an embodiment. Mast 130 may comprise a locking mechanism 132 that enables mast 130 to be locked at an angle A with respect to reference axis R. For example, locking mechanism 132 may comprise a plurality of lateral apertures, and platform 112 may comprise a corresponding lateral aperture (not shown), which is configured to align with each of the plurality of lateral apertures of locking mechanism 132, depending on angle A of mast 130. When the lateral aperture of platform 112 is aligned with one of the plurality of lateral apertures of locking mechanism 132, a pin may be inserted through both lateral apertures to thereby lock mast 130, and drill 140 by virtue of its fixation to mast 130, at angle A. Locking mechanism 132 may be used during normal drilling operations. However, in an embodiment, locking mechanism 132 is not used during the automated changing of drill bits.

Drill 140 may comprise a hollow, hydraulically operated drill cylinder 142 that actuates a drill string 144. Drill string 144 may be configured to extend and retract parallel to drill cylinder 142, along drill axis D. Drill string 144 may extend and retract based on the pressure of hydraulic fluid, contained within drill cylinder 142, that is applied to the end of drill string 144 through a wire rope and sheave mechanism or any other suitable mechanism. This hydraulic pressure and/or the travel of drill string 144 may be controlled by controller 150.

Within a sub-range of angles, drill axis D may intersect with magazine 200. Thus, when angle A of drill 140 is within this sub-range of angles, drill string 144 may be extended towards magazine 200 to interact with magazine 200 and/or retracted away from magazine 200 when the interaction with magazine 200 is completed. In this manner, drill string 144 may be operated to release used drill bits into magazine 200 and engage new drill bits held within magazine 200.

Magazine 200 is configured to hold a plurality of drill bits for the automated changing of drill bits on drilling rig 100. Magazine 200 may comprise a housing 210 and a magazine lid 220. The housing 210 is defined by at least one sidewall to define an interior volume. In the present example, the magazine 200 has a rectangular planform shape. In various other examples, the magazine could be triangular, hexagonal, or any other planform shape. Additionally, in preferred examples, the magazine lid 220 is made of lightweight materials to facilitate smooth operation of the magazine 200. Additionally, the lightweight lid allows a single person to manually operate the lid 220 for ordinary maintenance and restocking. In some examples, the lid 220 can be made of lightweight metal (e.g., aluminum) or polymer (e.g., plastic).

Housing 210 may be supported on platform 112 via a bracket 212. Bracket 212 may include a plate 214 that is configured to engage the platform 112 or another securement mechanism. Alternatively, bracket 212 may comprise other means for attaching or otherwise engaging housing 210 with platform 112. In an alternative embodiment, bracket 212 may be omitted, in which case housing 210 may be mounted directly on platform 112. In any case, bracket 212 and/or another mechanism of magazine 200 may be configured to fix housing 210 to platform 112 of drilling rig 100.

As shown in FIG. 3, bracket 212 engages with a securing channel 216. The securing channel 216 includes two, opposing C-channels spaced apart to secure the plate 214 The securing channel 216 may be oriented along a lateral axis that is horizontal parallel to the platform 112. The plate 214 is configured to slidably engage (e.g., attach) within the securing channel 216, such that magazine 200 slides into securing arrangement with the platform 112. In some examples, the magazine 200 is movable side-to-side within the securing channel 216 via hydraulic or electric actuators (not shown). In various examples, the magazine 200 can be actuatable to improve alignment with the drill axis D.

Drill Bit

Figure 4:
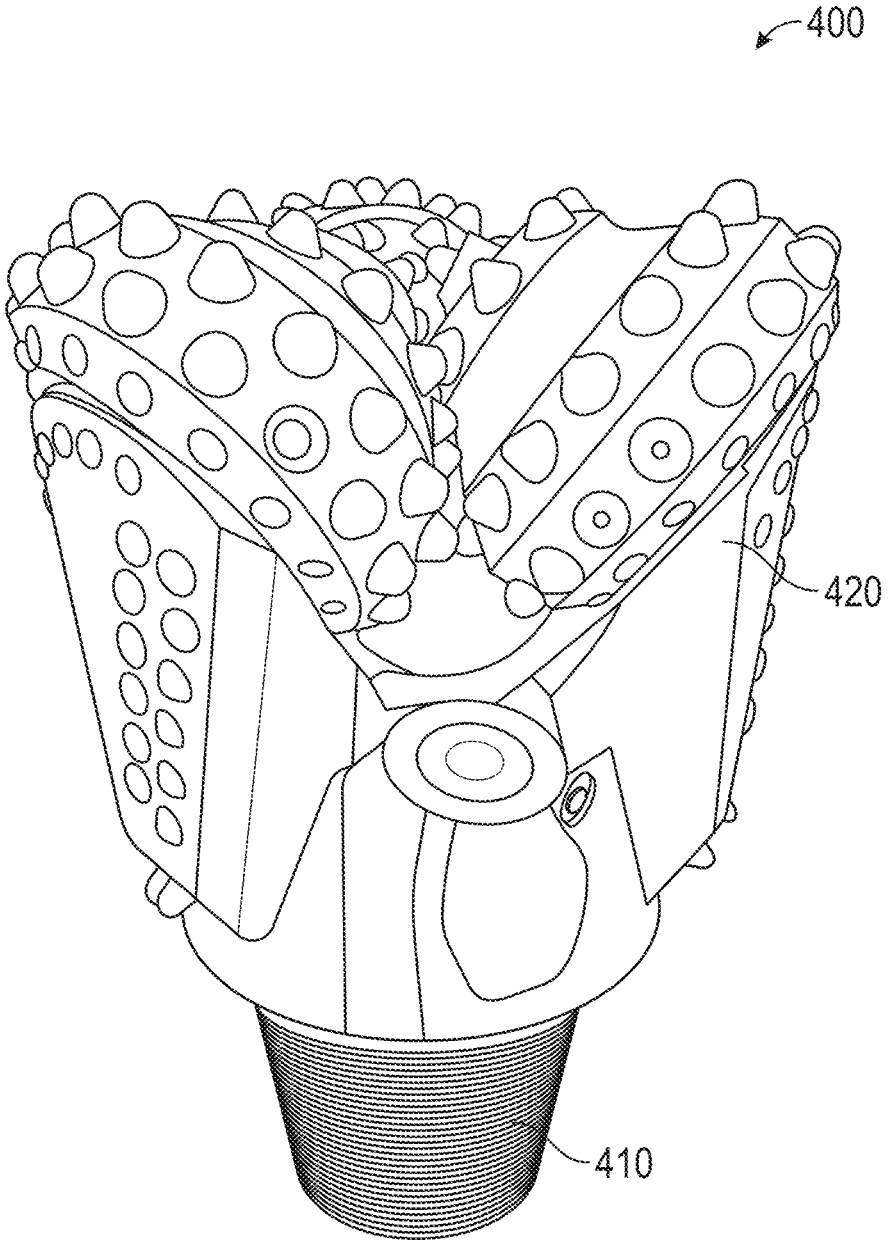
FIG. 4 illustrates a drill bit, according to an example.

FIG. 4 illustrates an example drill bit 400. Each drill bit 400 comprises an engagement end 410 and a drilling end 420. Engagement end 410 may be configured to engage with drill string 144. In particular, engagement end 410 may comprise a shank that is configured to be inserted within a socket on the drilling end of drill string 144. Alternatively, engagement end 410 could comprise a socket that is configured to receive the drilling end of drill string 144. In either case, an attachment and/or release mechanism may be used to respectively fix drill bit 400 to drill string 144 and unfix drill bit 400 from drill string 144. Any suitable mechanism may be used as the attachment and/or release mechanism.

In the illustrated embodiment, drilling end 420 comprises three rotating teeth. However, it should be understood that drilling end 420 of drill bit 400 may comprise any suitable mechanism(s) for drilling into a material surface. Different types of drill bits 400 may be specifically suited for different uses or materials. For example, one type of drill bit 400 may differ from another type of drill bit 400 in terms of size, drilling mechanism, and/or the like. Disclosed embodiments may operate with the same type of drill bit 400 or different types of drill bits 400.

Returning to FIG. 3, the magazine 200 includes the magazine lid 220. In the present example, the magazine lid 220 is configured to open and close. In the open configuration, the access panel 502 provides access to the open end of each of the plurality of drill-bit pockets within housing 210 having at least one sidewall. In the closed configuration, the lid 220 and the access panel 502 of the lid 220 prevent access to the open end of each of the plurality of drill-bit pockets within the housing 210 and protects the contents of the magazine from damage or environmental elements, such as dust, debris, and/or the like, damage from other mechanical components of drilling rig 100, and/or the like.

Magazine

Figure 5:
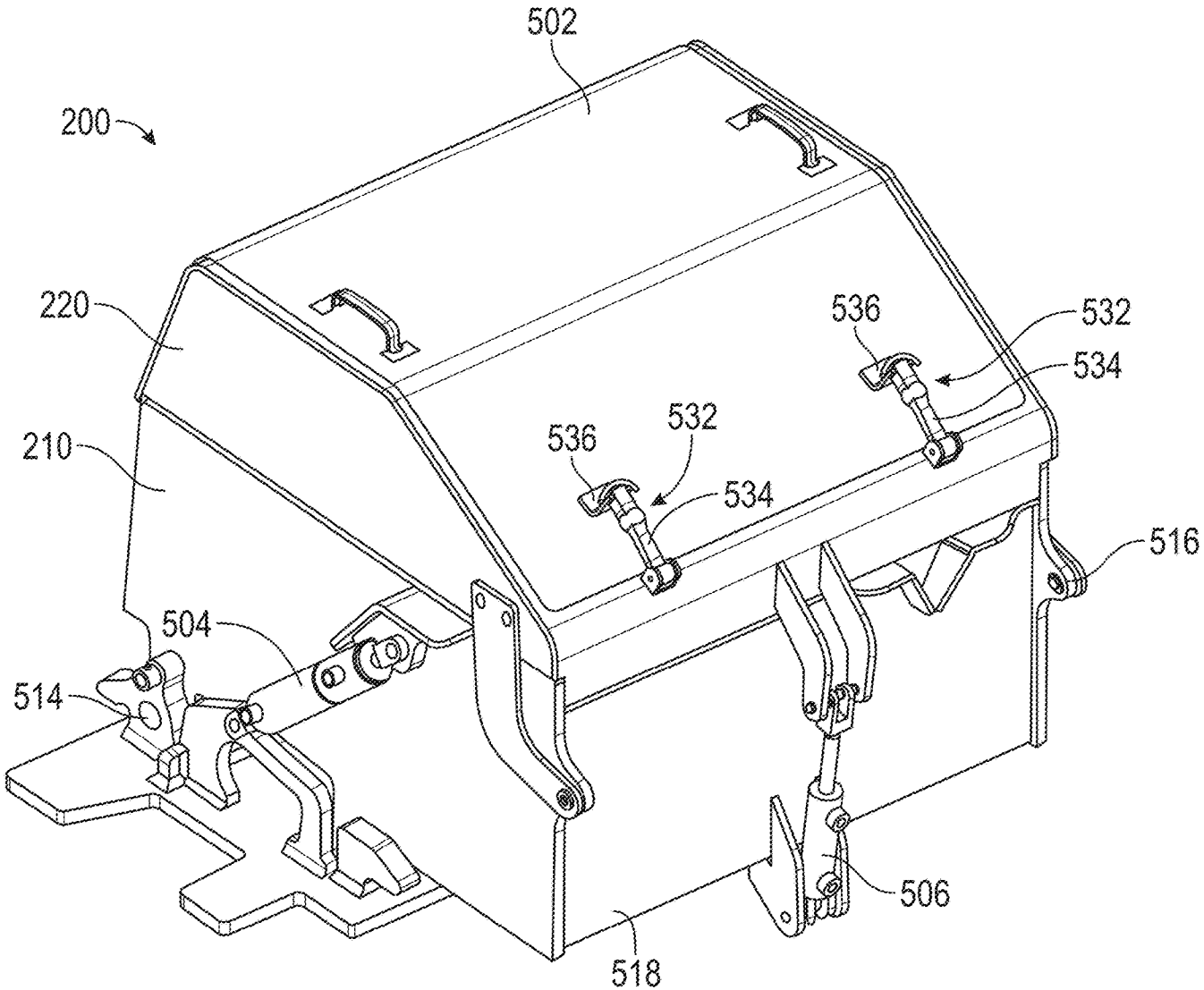
FIG. 5 illustrates a perspective view of an auto-bit changer magazine in accordance with the present disclosure.
Figure 6:
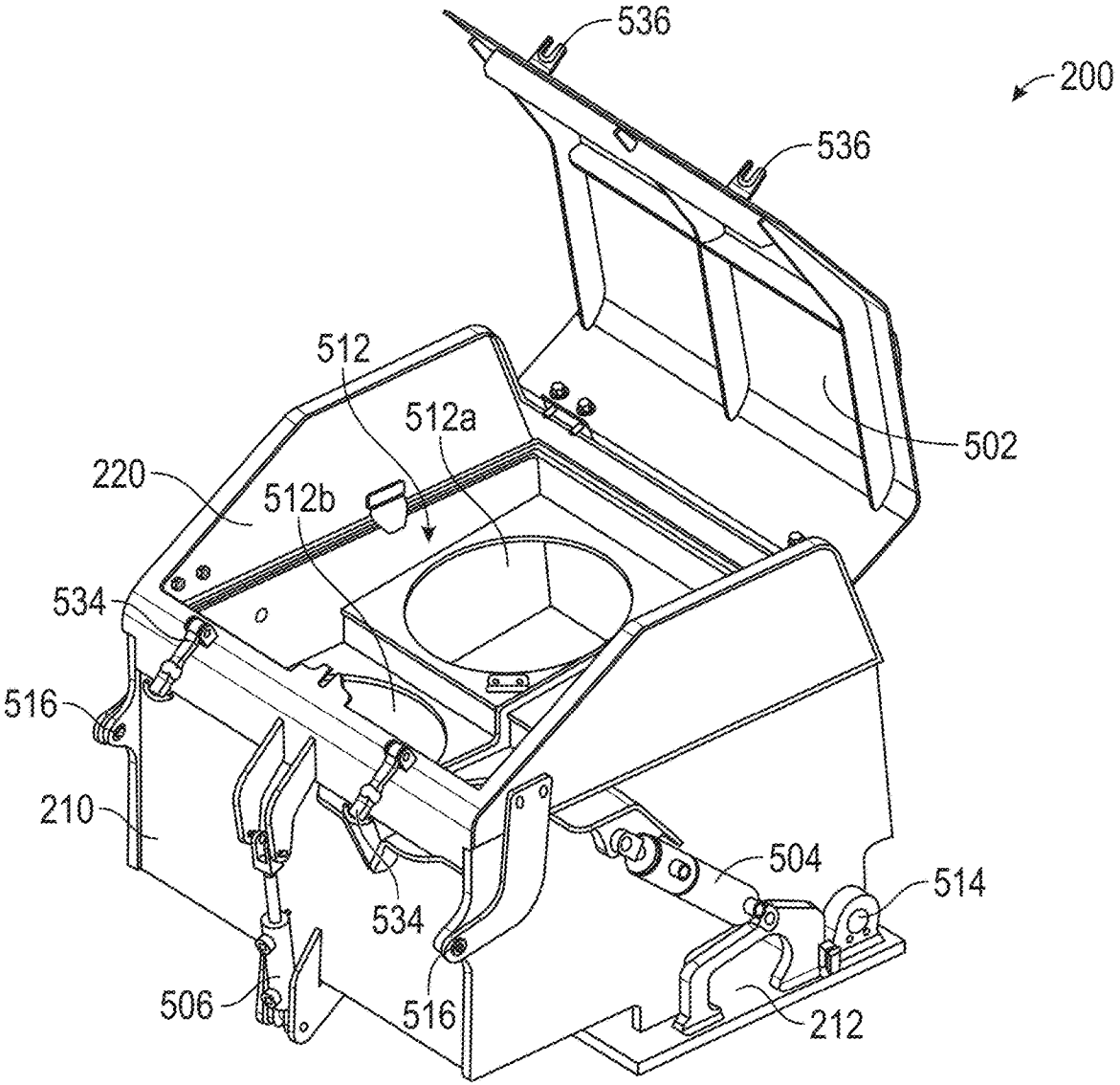
FIG. 6 illustrates a perspective view of an auto-bit changer magazine of FIG. 5 with an access door open.

FIGS. 5 and 6 illustrate the magazine 200 in greater detail. FIG. 5 illustrates the magazine 200 in a closed state and FIG. 6 illustrates the access panel 502 of the magazine 200 in an example open, maintenance state. In this embodiment, the magazine 200 includes two housing actuators 504 (only one shown in FIGS. 5 and 6) on opposite sides of the housing 210 and one magazine lid actuator 506. Further, the magazine 200 includes the bracket 212 pivotably coupled to the housing 210. The housing 210 is pivotably coupled to the bracket 212 along hinge 514 disposed on a first end of the bracket 212 and the lid 220 is pivotably coupled to the housing along hinge 516 disposed on a rear sidewall 518 of the housing 210. In some examples, when the magazine 200 is in the closed state, the lid 220 rests on rubber or plastic bumpers to act as a door stopper and facilitate the lid 220 smoothly closing on the housing 210.

In the present example, the housing actuators 504 and the lid actuator 506 are linear hydraulic actuators having at least a first state, a second state, and a plurality of states therebetween. In the present example, the first state corresponds to a collapsed length and the second state corresponds to an expanded length. The actuators 504 are pivotally coupled to both the bracket 212 and the housing 210. The actuator 504 is pivotally coupled to the bracket 212 between the first end including the hinge 514 and the second end opposite the first end. In other examples, the actuator(s) 504 could be any type of actuator including a pneumatic actuator or an electric motor. Additionally, in various examples, the magazine 200 could include more or fewer actuators.

Additionally, the magazine lid actuator 506 is a linear hydraulic actuator having at least a first state, a second state, and a plurality of states therebetween. In the present example, the first state corresponds to a collapsed length and the second state corresponds to an expanded length. The actuator 506 is pivotally coupled to the rear sidewall 518 of the housing 210 and the lid 220. In other examples, the actuator 506 could be any type of actuator including a pneumatic actuator or an electric motor. Additionally, in various examples, the lid 200 could include more or fewer actuators.

In the present example, the hinge 514 is disposed on a first end of the bracket 212. The hinge 516 is disposed on the rear sidewall 518. In various examples, the hinges 514, 516 can be reconfigured to correspond to any known hinge configurations. Alternatively, the housing 210 and bracket 212, as well as the lid 220 and the bracket 212 can be pivotally coupled with any known mechanical, pivotable connections.

Further illustrated in FIG. 5, the lid 220 includes access panel 502 shown in a closed configuration. The lid 220 includes latches 534 to secure the access panel 502 in a closed state. In the present example, the latches 532 include a latch arm 534 engaging a catch 536 disposed on the access panel 502. In various examples, the latches 534 can be reversed in orientation. Additionally, the lid 220 can include more or fewer latches 534 than shown in FIG. 5. In preferred examples, the latches 534 are configured for manual operation and facilitate maintenance and access to the contents of the housing 210.

Drill Bit Pockets

FIG. 6 illustrates the magazine 200 with the access panel 502 in an open configuration. Opening just the access panel 502 can be beneficial for maintenance and placement of drill bits 400 within the magazine 200. As shown in FIG. 6, the magazine 200 includes two columns of two drill-bit pockets 512, illustrated as first drill-bit pocket 512A and second drill-bit pocket 512B. In various other examples, the magazine 200 can include more or fewer columns with more or fewer drill-bit pockets 512. As used herein, the term "column" refers to a plurality of drill-bit pockets 512 arranged generally along the reference axis R. Within a column, each drill-bit pocket 512 is at a different position than any other drill-bit pocket 512. It should be understood that the drill-bit pockets 512 within a column may all be centered on the same axis or may be offset from each other.

Each drill-bit pocket 512 has a closed end and an open end and is configured to receive at least a portion of drilling end 420 of drill bit 400, such that engagement end 410 of drill bit 400 is accessible at the open end of that drill-bit pocket 512. At least a portion of engagement end 410 of drill bit 400 may protrude from drill-bit pocket 512, and/or the diameter of drill-bit pocket 512 may be large enough to accommodate the outer diameter of the drilling end of drill string 144, such that drill string 144 can access engagement end 410 of drill bit 400 within drill-bit pocket 512. In either case, the drilling end of drill string 144 is able to access engagement end 410 of each drill bit 400 held in magazine 200.

Each drill-bit pocket 512 in magazine 200 may have the same size and shape as every other drill-bit pocket 512. In some examples, each drill-bit pocket 512 may be angled (relative to reference axis R as shown in FIG. 1) differently than other drill-bit pocket(s) 512 in the same column. Alternatively, one or more drill-bit pockets 512 may have a different size and shape than one or more other drill-pockets 512 within the same magazine 200.

In an embodiment, each drill-bit pocket 512 is configured to hold the same type of drill bit 400. In other words, magazine 200 may hold drill bits 400 of a single type. In an alternative embodiment, magazine 200 holds drill bits 400 of different types. In this case, each of one or more of the plurality of drill-bit pockets 512 in magazine 200 may be configured to hold a different type of drill bit 400 than at least one other one of the plurality of drill-bit pockets 512 in magazine 200. It should be understood that drill bits 400 of different types may have different uses. For example, a drill bit 400 of a first type may be configured to drill through a different type of material than a drill bit 400 of a second type, drill a larger hole than a drill bit 400 of the second type, and/or the like.

While magazine 200 is illustrated with a column consisting of two drill-bit pockets 512, it should be understood that each column in magazine 200 may comprise any feasible number of drill-bit pockets 512, including three or more laterally arranged drill-bit pockets 512. For example, magazine 200 may be expanded in length and/or width to include one or more additional drill-bit pockets 512, positioned adjacent first drill-bit pocket 512A and/or adjacent second drill-bit pocket 512B within the column.

Magazine 200 may consist of a single column of drill-bit pockets 512. Alternatively, in an embodiment comprising rail(s) or another mechanism for laterally sliding magazine 200, magazine 200 may comprise a plurality of columns of drill-bit pockets 512. In this case, magazine 200 will comprise both lateral rows and lateral columns of drill-bit pockets 512, with each row comprising two or more drill-bit pockets 512 and each column comprising two or more drill-bit pockets 512. Within a row, each drill-bit pocket 512 in the row may hold a drill bit 400 at the same angle as every other drill-bit pocket 512 in that row. Conversely, within a column, each drill-bit pocket 512 in the column may hold a drill bit 400 at a different angle than every other drill-bit pocket 512 in that column. In some examples, lower drill-bit pockets 512 in the column having a larger angle than higher drill-bit pockets 512 in the column.

The plurality of drill-bit pockets 512 in magazine 200 may comprise two or more rows of laterally arranged drill-bit pockets 512. In the illustrated embodiment, magazine 200 consists of two rows of drill-bit pockets 512. These rows are illustrated as a first row comprising drill-bit pockets 512A and 512C and a second row comprising drill-bit pockets 512B and 512D, with the second row positioned adjacent the first row. In the first row, all of the drill-bit pockets 512 (i.e., 512A and 512C in the illustrated embodiment) hold drill bits 400 (i.e., 400A and 400C in the illustrated embodiment) at a first angle, and, in the second row, all of the drill-bit pockets 512 (i.e., 512B and 512D in the illustrated embodiment) hold drill bits 400 (i.e., 400B and 400D in the illustrated embodiment) at a second angle. The second angle is smaller than the first angle.

INDUSTRIAL APPLICABILITY

Operation of the Magazine

Figure 7:
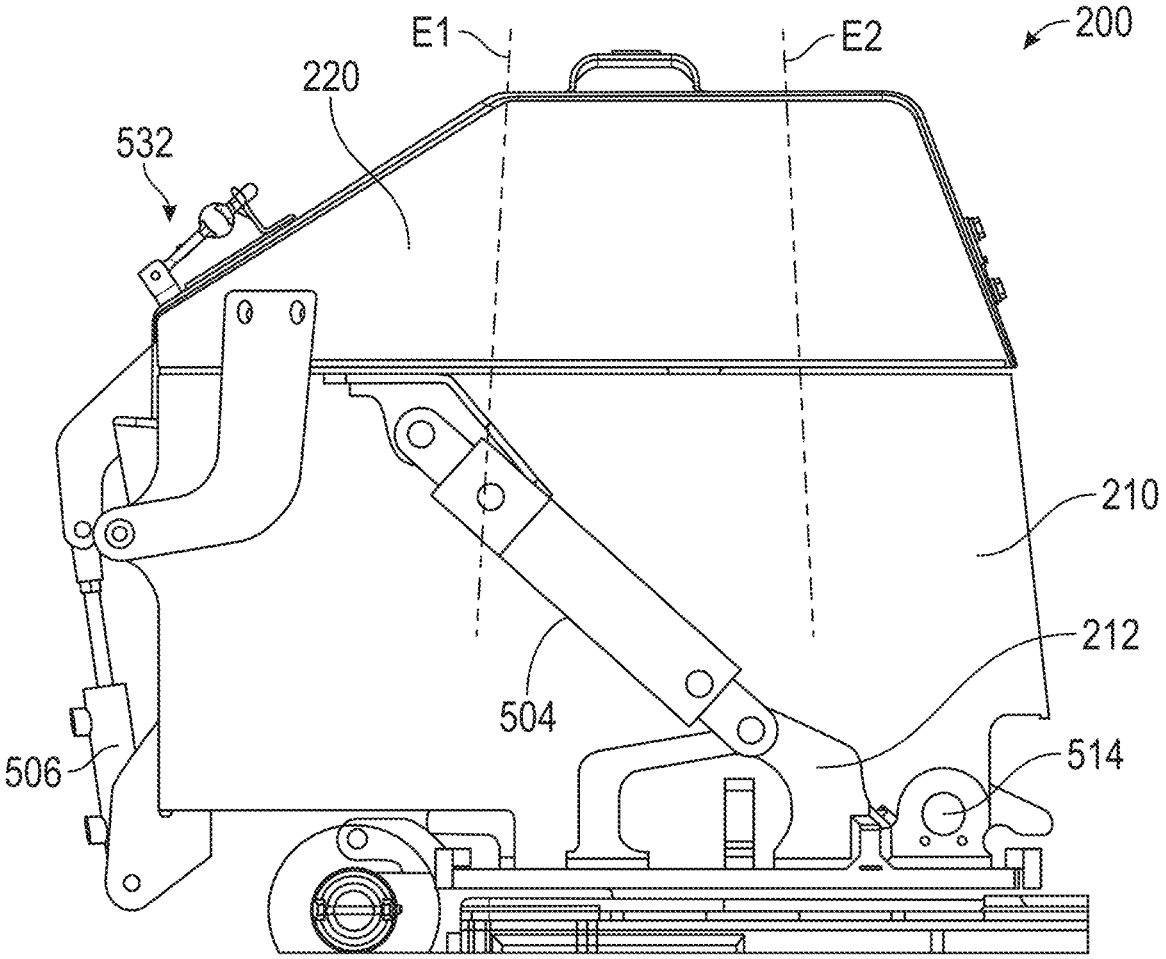
FIG. 7 is a side view of the auto-bit changer magazine of FIG. 5 in a parked position.
Figure 8:
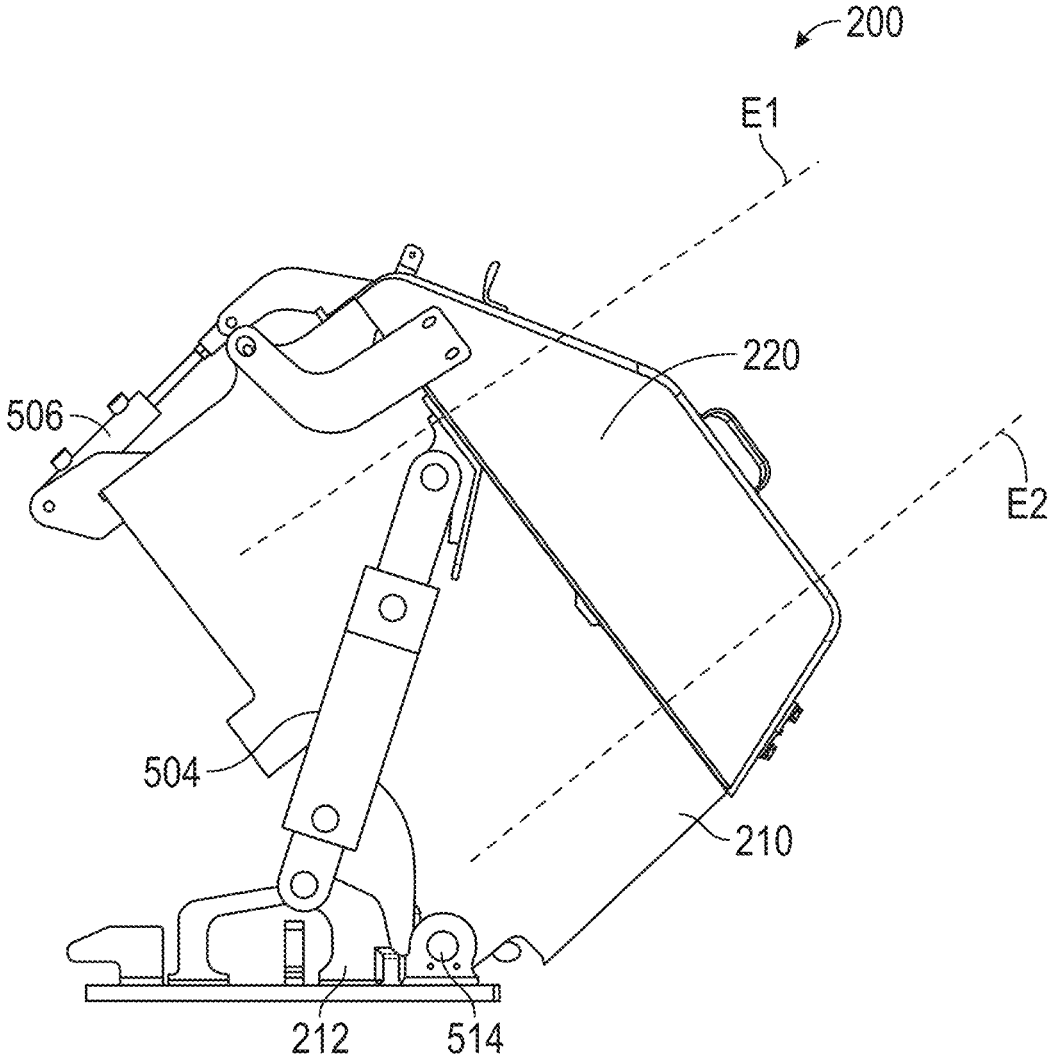
FIG. 8 is a side view of the auto-bit changer magazine of FIG. 5 in a tilted, closed position.
Figure 9:
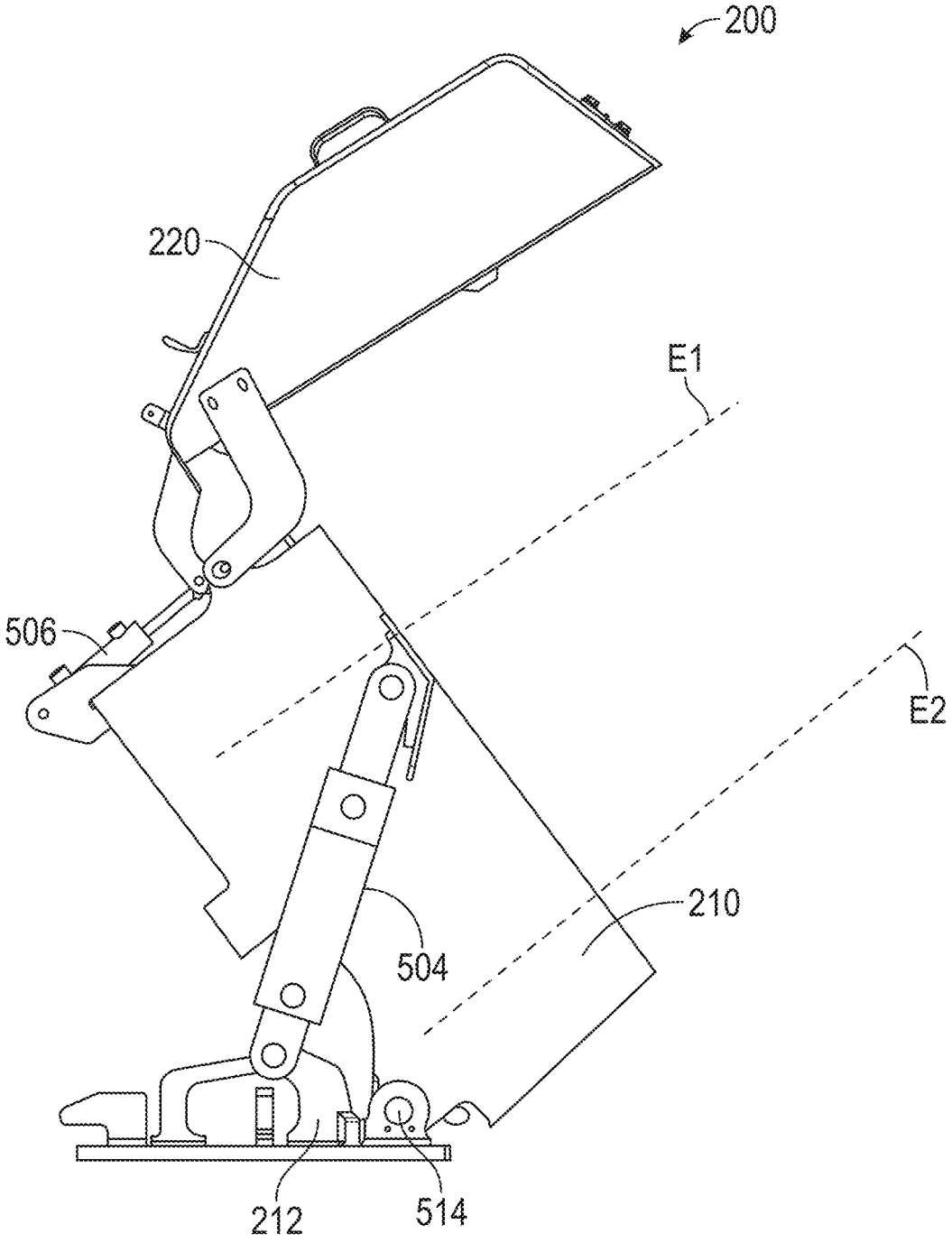
FIG. 9 is a side view of the auto-bit changer magazine of FIGS. 5 and 7 in a fully opened position.

FIGS. 7-9 illustrate an example operation of the magazine 200. In some examples, the magazine 200 is actuated under the control of controller 150, but could be manually operated by a person. Operation of the magazine includes opening of the magazine 200 via actuation of the actuators 504, 506 (shown in FIG. 5). In FIG. 7, the magazine 200 is in a parked, closed position. In FIG. 8, the magazine is in a tilted, closed position. In FIG. 9, the magazine 200 is in a tilted, open position. In preferred examples, the magazine 200 smoothly transitions from the parked, closed position into the tilted, open position. However, in some examples, the magazine 200 may be configured to transition stepwise between the parked, closed position into the tilted, open position.

As shown in FIG. 7, the lid 220 encloses the housing 210. In the parked, closed position, the magazine 200 maintains a low-profile and reduces the amount of space taken up on the platform 112. Additionally, each of the drill pockets 512 (shown in FIG. 6) defines an engagement axis E. In the closed position, the engagement axis E extends generally vertical relative to the platform and reference axis R. In the example of FIG. 7, the engagement axis E is not aligned with the mast 130 or the drill 140 (FIG. 3). The engagement axis E of a drill-bit pocket 512 represents the axis along which drill string 144 needs to align to properly engage with an engagement end 410 of a drill bit 400 held within the drill-bit pocket 512.

Turning to FIG. 8, the controller 150 activates the housing actuators 504. When the actuators 504 are activated, the hydraulic actuator 504 extends in length and causes the housing 210 to pivot about the hinge 514. As the housing 210 pivots about the hinge 514, the lid 220 and the actuator 506 also pivot about the hinge 514. Because the hinge 514 is disposed proximate a front sidewall 1002 of the housing 210, the front sidewall 1002 rotates 220 forwards. At the same time the front sidewall 1002 rotates forward, the rear sidewall 518 rotates up and forward. As shown in FIG. 8, the engagement axis E of the drill pockets 512 also rotate about the hinge 514. In the tilted position, the engagement axis E is aligned with the drill axis D, but the lid 220 is still in a closed position. As shown in FIG. 8, the housing 210 is rotated about the hinge 514 approximately 60 degrees (°), but in various examples could be rotated between 30° and 90°. In some examples, the controller 150 stops rotating the housing 210 when the housing 210 is in the tilted position. Additionally or alternatively, the magazine 200 can include a mechanical stop to prevent the housing 210 from tilting too far.

Turning to FIG. 9, the housing 210 is in the tilted, fully-open position. The lid actuator 506 retracts to pivot the lid 220 about the hinge 516. In the present example, the lid actuator 506 retracts and causes the lid 220 to rotate about the hinge 516 such that the lid 220 is approximately 90 degrees (°) relative to the housing 210. In some examples, the controller 150 ceases operation of the actuator 506 when the lid is in the fully open position, while in other examples, the actuator 506 is mechanically limited from extending beyond the tilted, fully-open position. As shown in FIG. 9, the lid 220 does not cover or enclose the housing 210 when in the fully-open position. As a result, the mast 130 has access to the drill pockets 512 of the magazine 200.

Drill Bit Changing

As discussed elsewhere herein, mast 130 is configured to rotate or tilt drill 140 between a range of angles with respect to reference axis R, for example, by itself tilting between the range of angles, under the control of controller 150. During the changing of a drill bit 400, controller 150 may control mast 130 to tilt drill 140 to align drill axis D with engagement axis E1 of the drill-bit pocket 512 (e.g., 512A or 512C) in the first row, or to align drill axis D with engagement axis E2 of the drill-bit pocket 512 (e.g., 512B or 512D) in the second row. In addition, in an embodiment with a plurality of columns of drill-bit pockets 512, controller 150 may control magazine 200 to slide within the securing channel 216, so as to align drill axis D with a particular column. Thus, controller 150 may control the angle of drill 140, the angle of the housing 210, and/or the lateral position of magazine 200 to align drill axis D with the engagement axis E of any one of the plurality of drill-bit pockets 512 in magazine 200.

The selection of the angle of drill axis D represents the selection of a particular row of drill-bit pockets 512, and the selection of the lateral position of magazine 200 represents the selection of a particular column of drill-bit pockets 512. It should be understood that the selection of a particular row and a particular column defines the intersection point of drill axis D with magazine 200 and thereby represents the selection of a particular drill-bit pocket 512.

Within each column of drill-bit pockets 512, each drill-bit pocket 512 may angle a respective drill bit 400, held within, at a different angle B with respect to reference axis R than any other drill-pocket 512 in the same column. In other words, within the column, the engagement axis E of each drill-bit pocket 512 may have a different angle than the engagement axis E of any other drill-bit pocket 512 within the same column. In general, the angles of the plurality of drill-bit pockets 512 in a column will decrease from the bottom to the top of the column. In other words, the angle of the drill-bit pocket 512 at the bottom of the column (i.e., closest to platform 112 when the magazine is in the open, tilted position) will be the largest angle for the column, and the angle B of the drill-bit pocket 512 at the top of the column (i.e., farthest from platform 112) will be the smallest angle for the column, with the angles of any drill-bit pockets 512 between the bottom and top drill-bit pockets 512 being incrementally between the largest and smallest angles.

As an example, first drill-bit pocket 512A has a first engagement axis E1, which has a first angle with respect to reference axis R, and second drill-bit pocket 512B has a second engagement axis E2, which has a second angle with respect to reference axis R. First drill-bit pocket 512A is positioned vertically below second drill-bit pocket 512B, within the same column. First drill-bit pocket 512A holds a first drill bit 400A at the first angle, for example, by being angled at the first angle B1 with respect to reference axis R. Similarly, second drill-bit pocket 512B holds a second drill bit 400B at the second angle, for example, by being angled at the second angle with respect to reference axis R. Notably, since second drill-bit pocket 512B is positioned vertically above first drill-bit pocket 512A, the second angle is smaller than the first angle.

Once drill axis D has been aligned with a particular engagement axis E of a particular drill-bit pocket 512, drill string 144 may be operated to interact with that particular drill-bit pocket 512, under the control of controller 150. In the illustrated example, drill axis D is aligned with the engagement axis E of drill-bit pocket 512D, and therefore, drill string 144 may be operated to interact with drill-bit pocket 512D. If the selected drill-bit pocket 512D is occupied by a drill bit 400 (e.g., a new drill bit 400) and no drill bit 400 is currently installed on the drilling end of drill string 144, this interaction may comprise extending drill string 144 until the drilling end of drill string 144 engages with engagement end 410 of the drill bit 400 occupying drill-bit pocket 512D, and then fixing the drill bit 400 in drill-bit pocket 512D to the drilling end of drill string 144 via an attachment mechanism, to thereby install the drill bit 400 on the drill string 144. In this case, drill string 144 may then be retracted, and mast 130 and/or drill 140 may be controlled to begin a drilling operation with the installed drill bit 400. On the other hand, if the selected drill-bit pocket 512D is empty and a drill bit 400 (e.g., a used drill bit 400) is currently installed on the drilling end of drill string 144, this interaction may comprise extending drill string 144 until drilling end 420 of the drill bit 400 is within drill-bit pocket 512D, and then releasing the drill bit 400 from drill string 144 into drill-bit pocket 512D via a release mechanism. In this case, drill string 144 may then be retracted, and mast 130, drill 140, and/or magazine 200 may be controlled to install a new drill bit 400 on the drilling end of drill string 144, as described above.

The invention claimed is:

1. A magazine for auto drill-bit changes, the magazine comprising:

a housing including at least one sidewall and at least two drill-bit pockets;

a bracket having a first end and a second end, the housing pivotably coupled to the first end of the bracket;

a first actuator pivotably coupled to both the housing and the bracket, the first actuator actuatable between a first state and a second state;

a lid dimensioned to close the housing, the lid pivotably coupled to the housing wherein the lid includes an access panel that has an open configuration and a closed configuration, and wherein the access panel provides access to the housing when the access panel is in the open configuration; and a second actuator pivotably coupled to the housing and to the lid, the second actuator actuatable between a first state and a second state;

wherein the housing is actuatable between a parked position and a tilted position when the first actuator transitions from the first state to the second state, and wherein the lid transitions between a closed position and an open position when the second actuator transitions from the first state to the second state.

2. The magazine for auto-drill bit changes of claim 1, wherein the second actuator is a hydraulic actuator.

3. The magazine for auto-drill bit changes of claim 1, wherein the housing rotates between 40 degrees (°) and 65° from the parked position and the tilted position.

4. The magazine for auto-drill bit changes of claim 1, wherein the first actuator and the second actuator are actuatable independently.

5. A drilling rig, comprising:

a machine body comprising a platform that defines a reference axis;

a mast attached to the machine body and configured to tilt a drill between a range of angles with respect to the reference axis, wherein the range of angles includes a first angle and a second angle;

one or more ground-engaging members configured to facilitate the drill engaging a ground; and the magazine of claim 1, wherein the magazine is attached to the platform and each of the one or more ground engaging members are disposed in one of the drill-bit pockets.

6. The drilling rig of claim 5, wherein the second actuator is a hydraulic actuator.

7. The drilling rig of claim 5, wherein the housing rotates between 40 degrees (°) and 65° from the parked position and the tilted position.

8. The drilling rig of claim 7, wherein an axis of the mast and an axis of at least one of the drill-bit pockets are aligned when the housing is in the tilted position.

9. The drilling rig of claim 7, wherein the first actuator and the second actuator are actuatable independently.

10. A method of auto-changing a drill bit, comprising:

determining, via a controller, to change a used drill bit of a drill string of a drill, the drill including a machine body comprising a platform that defines a reference axis and a mast attached to the machine body and configured to tilt the drill between a range of angles with respect to the reference axis, wherein the range of angles includes a first angle and a second angle;

operating a magazine to facilitate auto-changing a drill bit, the magazine including:

a housing including at least one sidewall, a first drill-bit pocket having a first engagement axis oriented at a third angle relative to the reference axis, and a second drill-bit pocket having a second engagement axis oriented at a fourth angle relative to the reference axis, the fourth angle being different than the third angle;

a bracket having a first end and a second end, the housing pivotably coupled to the first end of the bracket;

a first actuator pivotably coupled to both the housing and the bracket, the first actuator actuatable between a first state and a second state;

a lid dimensioned to close the housing, the lid pivotably coupled to the housing; and a second actuator pivotably coupled to the housing and to the lid, the second actuator actuatable between a third state and a fourth state;

wherein operating the magazine includes:

activating the first actuator from the first state to the second state to transition the housing from a parked position to a tilted position; and activating the second actuator from the third state to the fourth state to transition the lid from a closed position to an open position; and in response to determining to change the used drill bit, selecting the first drill-bit pocket of the magazine, wherein the first drill-bit pocket is empty;

controlling the mast to tilt the drill to an angle, with respect to the reference axis, that matches the third angle of the first drill-bit pocket;

operating the drill string of the drill to release the used drill bit into the first drill-bit pocket including axial movement of the drill string along the first engagement axis;

selecting the second drill-bit pocket in the magazine, wherein the second drill-bit pocket includes a drill bit;

controlling the mast to tilt the drill to an angle, with respect to the reference axis, that matches the fourth angle of the second drill-bit pocket; and operating the drill string of the drill to engage a new drill bit held by the second drill-bit pocket including axial movement of the drill string along the second engagement axis.

11. The method of claim 10, wherein activating the first actuator causes the housing to rotate between 40 degrees (°) and 65° from the parked position and the tilted position.

12. The method of claim 10, wherein activating the second actuator causes the lid to rotate between 60 degrees (°) and 90°.

13. The method of claim 10, further comprising activating the second actuator after activating the first actuator.

* * * * *